US012735844B2

(12) United States Patent
Lebsanft et al.

(10) Patent No.: US 12,735,844 B2
(45) Date of Patent: Sep. 15, 2026

(54) COATED PAPER FOR USE AS PACKAGING MATERIAL

(71) Applicant: Neenah Gessner GmbH, Bruckmühl (DE)

(72) Inventors: Martin Lebsanft, Feldkirchen-Westerham (DE); Armin Niederhuber, Bruckmühl (DE); Simon Gravot, Munich (DE); Peter Karl, Pullach im Isartal (DE)

(73) Assignee: Neenah Gessner GmbH (DE)

( * ) Notice: Subject to any disclaimer, the term of this patent is extended or adjusted under 35 U.S.C. 154(b) by 232 days.

(21) Appl. No.: 18/562,566

(22) PCT Filed: May 19, 2022

(86) PCT No.: PCT/EP2022/063599
§ 371 (c)(1),
(2) Date: Nov. 20, 2023

(87) PCT Pub. No.: WO2022/243445
PCT Pub. Date: Nov. 24, 2022

(65) Prior Publication Data

US 2024/0279876 A1 Aug. 22, 2024

(30) Foreign Application Priority Data

May 21, 2021 (WO) ..... PCT/EP2021/063645

(51) Int. Cl.

| | |
|---|---|
| ***D21H 27/10*** | (2006.01) |
| ***B65D 65/40*** | (2006.01) |
| ***B65D 65/42*** | (2006.01) |
| ***B65D 65/46*** | (2006.01) |
| ***D21H 19/12*** | (2006.01) |
| ***D21H 19/40*** | (2006.01) |
| ***D21H 19/44*** | (2006.01) |
| ***D21H 19/74*** | (2006.01) |
| ***D21H 19/82*** | (2006.01) |
| ***D21H 27/02*** | (2006.01) |

(52) U.S. Cl.
CPC ..... *D21H 27/10* (2013.01); *B65D 65/40* (2013.01); *B65D 65/42* (2013.01); *B65D 65/466* (2013.01); *D21H 19/12* (2013.01); *D21H 19/40* (2013.01); *D21H 19/44* (2013.01); *D21H 19/74* (2013.01); *D21H 19/826* (2013.01); *D21H 27/02* (2013.01); *B65D 2565/382* (2013.01)

(58) Field of Classification Search
CPC ..... D21H 27/10; D21H 19/12; D21H 19/40; D21H 19/44; D21H 19/74; D21H 19/826; D21H 27/02; D21H 19/28; D21H 19/34; D21H 19/52; D21H 19/54; D21H 19/84; D21H 25/005; D21H 19/18; D21H 25/00; B65D 65/40; B65D 65/42; B65D 65/466; B65D 2565/382; B31F 1/12
See application file for complete search history.

(56) References Cited

U.S. PATENT DOCUMENTS

| | | | | |
|---|---|---|---|---|
| 5,582,670 | A | 12/1996 | Andersen et al. | |
| 8,871,319 | B2 * | 10/2014 | Stanley | B65D 65/466 428/34.7 |
| 9,732,474 | B2 * | 8/2017 | Koenig | D21H 19/12 |
| 9,744,556 | B2 * | 8/2017 | Skupin | B05D 7/00 |
| 10,590,606 | B2 * | 3/2020 | Mongrain | D21H 19/56 |
| 10,730,959 | B2 * | 8/2020 | Spender | C08L 91/00 |
| 12,203,217 | B2 * | 1/2025 | Wundlechner | C08L 91/06 |
| 12,297,601 | B2 * | 5/2025 | Vishtal | D21H 23/50 |
| 2002/0012759 | A1 | 1/2002 | Asayama et al. | |
| 2005/0112387 | A1 | 5/2005 | Druckrey et al. | |
| 2014/0050934 | A1 * | 2/2014 | Siegenthaler | D21C 5/02 428/458 |
| 2014/0186644 | A1 * | 7/2014 | Dellinger | C09D 193/04 428/535 |
| 2018/0171559 | A1 | 6/2018 | Hipps, Sr. et al. | |
| 2019/0323177 | A1 * | 10/2019 | Spender | D21H 17/26 |
| 2020/0002572 | A1 * | 1/2020 | Spender | C09D 191/00 |
| 2020/0140575 | A1 * | 5/2020 | Spender | D21H 17/72 |
| 2020/0385929 | A1 * | 12/2020 | Baumlin | D21H 27/06 |
| 2021/0002828 | A1 | 1/2021 | Grundl et al. | |
| 2022/0403602 | A1 * | 12/2022 | Schwaiger | D21G 1/0233 |
| 2024/0218601 | A1 * | 7/2024 | Niederhuber | D21H 19/24 |
| 2024/0279876 | A1 * | 8/2024 | Lebsanft | D21H 19/28 |
| 2024/0344272 | A1 * | 10/2024 | Luo | D21H 19/28 |

(Continued)

FOREIGN PATENT DOCUMENTS

| | | | | |
|---|---|---|---|---|
| EP | 4180572 | A1 * | 5/2023 | D21H 27/10 |
| EP | 4146743 | B1 * | 7/2024 | C09D 5/14 |
| EP | 3969280 | B1 * | 1/2026 | C23C 14/24 |
| KR | 20250130648 | A * | 9/2025 | D21H 27/10 |
| WO | 2010085569 | A1 | 7/2010 | |
| WO | WO-2012143323 | A1 * | 10/2012 | B32B 15/08 |
| WO | 2020209781 | A1 | 10/2020 | |
| WO | WO-2022242875 | A1 * | 11/2022 | D21H 19/54 |
| WO | WO-2022243445 | A1 * | 11/2022 | D21H 19/28 |
| WO | WO-2023081990 | A1 * | 5/2023 | D21H 27/10 |
| WO | WO-2024141669 | A1 * | 7/2024 | D21H 27/10 |

OTHER PUBLICATIONS

International Search Report and Written Opinion; International Application No. PCT/EP2022/063599; Sep. 8, 2022.

(Continued)

*Primary Examiner* — Jose A Fortuna

(74) *Attorney, Agent, or Firm* — Farber LLC

(57) ABSTRACT

The present invention relates to a, preferably heat-sealable, coated paper comprising a cellulose layer and a coating on at least one side of the cellulose layer, wherein the coating comprises a wax and a polymer selected from the group consisting of polyester, polysaccharide, polysaccharide ester, polysaccharide ether and polysaccharide ether ester, and a packaging comprising the coated paper, as well as a method of manufacturing a coated paper.

30 Claims, No Drawings

(56) References Cited

U.S. PATENT DOCUMENTS

| | | | | |
|---|---|---|---|---|
| 2025/0011614 | A1* | 1/2025 | Ishii | C09D 7/63 |
| 2025/0122672 | A1* | 4/2025 | Bartolucci | A61K 8/20 |

OTHER PUBLICATIONS

International Search Report and Written Opinion; International Application No. PCT/EP2021/063645; Feb. 24, 2022.

* cited by examiner

COATED PAPER FOR USE AS PACKAGING MATERIAL

CROSS-REFERENCE TO RELATED APPLICATIONS

This application is a national stage application, filed under 35 U.S.C. § 371, of International Patent Application No. PCT/EP2022/063599 filed on May 19, 2022, which claims the benefit of International Patent Application No. PCT/EP2021/063645, filed on May 21, 2021, the entire disclosures of which are incorporated herein by reference for all purposes.

TECHNICAL FIELD

The present invention relates to a coated paper, a packaging comprising the coated paper and method for the manufacture thereof.

PRIOR ART

Plastics have become the dominant material for the production of various industrial products due to their low costs and durability. Single use plastics, or disposable plastics, are used only once before they are thrown away. Packaging materials are conventionally made of single use plastics. In order to reduce the amount of plastic produced, a single use plastic ban has been proposed.

The use of plastic films as packaging materials was considered advantageous in that the material can be folded according to the outer shape of the object and can then be heat-sealed.

It has been proposed to replace plastic films by coated paper. Yet, in order to obtain sufficient heat-sealability and the desired hydrophobicity and barrier properties, the coating of such coated paper comprise various ecologically undesirable components making conventional coated paper an industrial product which is not sustainable.

EP 2 777 934 A1 relates to a paper based barrier packaging material comprising a plurality of coating layers disposed on a paper base material, wherein the plurality of coating layers includes a water vapor barrier layer on the paper base material and a gas barrier layer formed on the water vapor barrier layer. In each of these coating layers, a water-soluble or water-suspendable polymer is used as a binder resin. The binder resin of the water vapor barrier layer can be for example polyvinyl alcohol-based resin, a styrene-butadiene-based resin or an acrylic copolymer-based resin.

WO 94/25511 A1 relates to a composite sheet comprising a substrate layer having on at least one surface thereof a coating layer, the remote surface of said coating layer having thereon a flexible adherent layer. The adherent layer comprises a styrene-butadiene copolymer. The composite sheet is described to be suitable for use as a packaging film, particularly when laminated to a heat-sealable layer, preferably of polyethylene.

WO 2016/170229 A1 is directed to a coated paperboard comprising a base paperboard and at least a first precoating layer and at least two successive coating layers at least on a first surface of the base paperboard, wherein the first precoating layer comprises at least inorganic mineral filler particles and a binder, a second barrier coating layer having barrier properties is arranged on top of the first precoating layer, and a third heat sealable coating layer is arranged on top of the second coating layer, the third coating layer comprising a heat sealable polymer, preferably styrene-butadiene latex.

WO 2016/183314 A1 relates to coated substrates comprising cellulose-based substrates with surface-treated aqueous-based polymer coatings. In some embodiments, the aqueous-based polymer coatings are surface-treated using corona treatment. The first aqueous-based polymer coating preferably comprises a pure acrylic copolymer, a styrene-acrylic copolymer, a styrene-butadiene copolymer, a vinyl acrylic copolymer, or a combination thereof.

WO 2020/216961 A1 relates to a heat-sealable coated paper comprising a cellulose layer and at least a coating on at least one side of the cellulose layer, wherein the coating comprises a styrene-butadiene copolymer, a packaging comprising the coated paper, as well as a method of manufacturing coated paper. The coated paper of WO 2020/216961 A1 may comprise a wax and may be creped.

There is thus a need for a more sustainable and more environmentally friendly heat-sealable coated paper.

SUMMARY

It is an object of the present invention to provide an environmentally friendly coated paper that can be used for single use packaging, has good workability (i.e. can be easily folded), and can be produced on a paper machine. The coated paper is preferably heat-sealable.

The inventors have surprisingly found that excellent hydrophobicity, barrier properties, workability, and heat-sealability can be achieved by using a coating comprising a wax and a polymer selected from the group consisting of polyester, polysaccharide, polysaccharide ester, polysaccharide ether and polysaccharide ether ester.

The coating of the coated paper of the present invention allows the complete replacement of conventionally used copolymers having a carbon-only backbone such as styrene-butadiene copolymer or styrene acrylic copolymer. The excellent hydrophobicity, barrier properties, workability, and heat-sealability is surprisingly maintained when a polymer selected from the group consisting of polyester, polysaccharide, polysaccharide ester, polysaccharide ether and polysaccharide ether ester is used in the coating instead of a conventionally used heat-sealable copolymer such as styrene-butadiene copolymer or styrene acrylic copolymer.

The heat-sealability of the paper renders the same suitable to be utilized on the same machine used for plastic packaging. Therefore, in the packaging industry, the shift from single use plastic to the more environmentally friendly and more sustainable heat-sealable coated paper of the present invention does not require additional investments.

A further advantage of the coated paper of the present invention, compared to standard coated paper, is that the coating can be produced from renewable resources.

Thus, the present invention offers an environmentally friendly alternative to plastic packaging and conventional coated paper packaging materials.

The heat-sealing functionality is achieved during the coating process using state-of-the-art coating machines. In addition, the paper performs well on existing form-, fill- and seal packing lines.

A further advantage of the coated paper of the present invention, compared to standard paper, is that the application of additional adhesive material on the sealing lines of the packaging is not necessary. This leads to a reduction of the costs for the production (i.e. simpler devices).

The coated paper according to the present invention has a coating as described in the appending claims and can be used as packaging of different products such as household goods or food.

The present invention is also concerned with a method of manufacturing the coated paper according to the present invention and a packaging comprising the coated paper according to the present invention.

DETAILED DESCRIPTION

Coated Paper

According to the first aspect, the present invention provides a coated, preferably heat-sealable, paper comprising (or consisting of) a cellulose layer and a coating on at least one side of the cellulose layer, wherein the coating comprises a wax and a, preferably thermoplastic, polymer selected from the group consisting of polyester, polysaccharide, polysaccharide ester, polysaccharide ether and polysaccharide ether ester. The coated paper according to the present invention is preferably biodegradable.

Preferred embodiments of the coated paper according to the first aspect of the present invention are subject to the dependent claims.

When the coated paper of the present invention is coated only on one side of the cellulose layer, the other side of the cellulose layer, which is not coated, can be readily printed using standard printing methods commonly known for packaging materials. Thus, the coated paper of the present invention is suitable for the production of printed packaging materials such as printed wrap products and packing bags.

When the coated paper of the present invention is coated only on one side of the cellulose layer with a coating comprising a wax and a polymer selected from the group consisting of polyester, polysaccharide, polysaccharide ester, polysaccharide ether and polysaccharide ether ester, the other side of the cellulose layer may be subsequently coated with a different coating composition. In particularly, the side of the cellulose layer, which is not coated with a wax and a polymer selected from the group consisting of polyester, polysaccharide, polysaccharide ester, polysaccharide ether and polysaccharide ether ester, may have a different coating, so that a barrier layer or a printable layer is formed. The barrier layer may be a layer having good barrier properties against at least one of oxygen, fats and oils.

Coating

A "coating" within the meaning of the present invention is a film formed on the surface of the cellulose layer. The coating is preferably a polymer-based film on the surface of the cellulose layer, more preferably a polymer-based adherent film, and most preferably a continuous film covering the complete surface of at least one side of the cellulose layer. That is, preferably no fibers of the cellulose layer are exposed to the outside in the coated paper according to the present invention. The coating can bind through heat-sealing the coated paper to itself or to another material, in particular to another coated paper according to the present invention, thus avoiding the need of further adhesive.

The coating comprising a wax and a polymer selected from the group consisting of polyester, polysaccharide, polysaccharide ester, polysaccharide ether and polysaccharide ether ester shows many advantages over other coatings and these will be apparent from the description below.

The coating used in the present invention is not sticky at room temperature and will preferably seal only at a temperature of 100 to 250° C., more preferably 150 to 200° C. The coating is particularly suitable for this application in that it shows excellent heat-sealability even for very little amount of coating on the cellulose layer The coating exhibits good water vapor barrier properties. More particularly, the coated paper of the present invention has a moisture vapor transmission rate (MVTR) of less than 200 gram per $m^2$ and day (g/($m^2$ d)), preferably less than 150 g/($m^2$ d) and more preferably less than 100 g/($m^2$ d). The moisture vapor transmission rate is measured according to ISO 15106-3:2003-01 at a relative humidity of 50% and at a temperature of 23° C.

In contrast to conventional coatings comprising petroleum-based synthetic materials, the coating of the coated paper of the present invention can be made from renewable materials, which improves the sustainability of the coated paper.

More particularly, the wax in the coating of the present invention and the polymer selected from the group consisting of polyester, polysaccharide, polysaccharide ester, polysaccharide ether and polysaccharide ether ester can be produced from renewable sources. The wax may be a plant wax or an animal wax and the polymer may be a biomass-based polymer. A biomass-based polymer within the meaning of the present invention is a polymer produced from biomass.

In a particularly preferable embodiment, the coating comprises a first coating layer and a second coating layer, wherein the first coating layer comprises the wax and a filler, and the second coating layer comprises the wax and the polymer.

The first coating layer improves the adhesion between the cellulose layer and the second coating layer. Moreover, the use of a first coating layer allows to reduce the coating weight of the second coating layer comprising the polymer, without deterioration of the mechanical properties of the coated paper. Thus, the amount of polymer, which may be a petroleum-based synthetic material, can be reduced. As a result, the proportion of renewable material is increased, so that a more environmentally friendly and more sustainable coated paper can be obtained. Due to its good mechanical properties, the coated paper comprising the first coating layer and the second coating layer is suitable for the use as packaging material. In addition, the reduction of the proportion of the relatively expensive polymer in the coated paper allows to reduce the production costs.

The use of a first coating layer comprising a wax and a filler further results in an increased tear resistance of the coated paper. Thus, the mechanical stability of the coated paper can be further improved. Moreover, the water vapor barrier properties can be improved by using a first coating layer comprising a wax and a filler.

Biomass

The term "biomass" within the meaning of the present invention is broadly understood as encompassing all kinds of plant and animal material and material derived from the same. According to a preferred embodiment, biomass as meant in the present specification shall not include petroleum or petroleum derived products. The biomass for use in the present invention may comprise macromolecular compounds, examples of which are lignin and polysaccharides, such as starch, cellulose, hemicellulose commonly also referred to as polyose, and glycogen.

As will be appreciated, certain kinds of biomass may include both, plant and animal-derived material. As examples, manure (dung), night soil and sewage sludge can be mentioned. While the biomass for use in the present invention is preferably plant biomass, i.e. biomass of or derived from plants, certain contents of animal biomass (i.e.

biomass of or derived from animals) may be present therein. For instance, the biomass may contain up to 30% of animal biomass.

According to a preferred embodiment, the biomass for use in the present invention, which is preferably plant biomass, contains more than 70 wt %, most preferably more than 90 wt %, of polysaccharides and lignines in terms of the solid contents of the biomass.

For instance, the plant biomass may be agricultural plant material (e.g. agricultural wastes) or all kinds of wood material.

Without limitation, examples of biomass are crop, agricultural food and waste, feed crop residues, wood (such as wood flour, wood waste, scrap wood, sawdust, chips and discards), straw (including rice straw), grass, leaves, chaff, and bagasse. Furthermore, industrial and municipal wastes, including waste paper can be exemplified.

The term "biomass" as used herein preferably also includes monosaccharides such as glucose, ribose, xylose, arabinose, mannose, galactose, fructose, sorbose, fucose and rhamnose, as well as oligosaccharides.

Biodegradability

Animal and plant waxes are usually biodegradable and non-toxic, so that a coating comprising animal or plant waxes is more environmentally friendly. The polymer selected from the group consisting of polyester, polysaccharide, polysaccharide ester, polysaccharide ether and polysaccharide ether ester may also be biodegradable.

A biodegradable component within the meaning of the present invention is a component that is capable of being decomposed by living organisms such as bacteria or fungi. A biodegradable component can thus be decomposed by the action of micro-organisms such as bacteria or fungi, with or without oxygen. More particularly, a biodegradable component within the meaning of the present invention preferably fulfils the requirements of at least one of the international industrial standards ISO 17088, EN 13432, EN 14995 and ASTM 6400.

In view of the above, the coating of the coated paper according to the first aspect of the present invention improves the resource's sustainability of the coated paper and its carbon footprint and renders it more environmentally friendly. Thus, a more environmentally friendly and more sustainable packaging material can be obtained.

Polymer

The coating on at least one side of the cellulose layer comprises a polymer selected from the group consisting of polyester, polysaccharide, polysaccharide ether, polysaccharide ester and polysaccharide ether ester.

The polymer selected from the group consisting of polyester, polysaccharide, polysaccharide ester, polysaccharide ether, and polysaccharide ether ester preferably exhibits a good heat-sealability.

Surprisingly, the use of a polymer selected from the group consisting of polyester, polysaccharide, polysaccharide ester, polysaccharide ether and polysaccharide ether ester allows the complete replacement of conventionally used copolymers having a carbon-only backbone such as styrene-butadiene copolymer or styrene acrylic copolymer and at the same time maintaining good heat-sealing properties of the coating. Polyester, polysaccharide, polysaccharide ester, polysaccharide ether and polysaccharide ether ester can be produced from biomass. Thus, in the coating used in the present invention, conventional petroleum-derived heat-sealable polymers can be completely replaced by polymers which can be produced from biomass. Thus, a sustainable and environmentally friendly coated paper exhibiting good heat-sealbility can be obtained.

The polymer is preferably a thermoplastic polymer. If the polymer is a thermoplastic polymer, the heat-sealability is further improved.

The polymer is preferably a thermoplastic polymer with a melting point in the range of 60 to 200° C., more preferably 100 to 180° C., and most preferably 110 to 180° C. When the coating of the coated paper of the present invention comprises a thermoplastic polymer having a melting point in the range of 60 to 200° C., the heat-sealability of the coated paper is improved. The heat-sealability is even further improved when the coating of the coated paper of the present invention comprises a thermoplastic polymer having a melting point in the range of 100 to 180° C.

In addition, the polymer is preferably a biomass-based polymer, so that the coated paper is more sustainable and environmentally friendly.

The polyester may be selected from the group consisting of polyhydroxyalkanoate, polylactic acid, polyglycolic acid, polybutylene succinate, polycaprolactone, polybutylene adipate terephthalate, and polylactic acid-polyethylene glycol.

Polyhydroxyalkanoates (PHAs) are polyesters of hydroxyalkanoic acids. Polyhydroxyalkanoates (PHAs) are thermoplastic. They may be homopolyesters or copolyesters and differ in their properties according to their chemical composition, namely the contained hydroxyalkanoic acid (s).

The PHA may be one or more polyester selected from the group consisting of poly(3-hydroxypropionate), poly(3-hydroxybutyrate), poly(4-hydroxybutyrate), poly(3-hydroxyvalerate), poly(3-hydroxyhexanoate), poly(3-hydroxyheptanoate), poly(3-hydroxyoctanoate), poly(3-hydroxynonanoate), poly(3-hydroxydecanoate), poly(3-hydroxyundecanoate), poly(3-hydroxydodecanoate), poly (3-hydroxytetradecanoate), poly(3-hydroxypentadecanoate), and poly(3-hydroxyhexadecanoate). The PHA may also be one or more copolyester obtained from copolymerization of two or more hydroxyalkanoic acids. More particularly, the PHA copolyester may be one or more selected from the group consisting of poly(3-hydroxypropionate-co-3-hydroxybutyrate), poly(3-hydroxypropionate-co-4-hydroxybutyrate), poly(3-hydroxybutyrate-co-4-hydroxybutyrate), poly(3-hydroxybutyrate-co-3-hydroxyvalerate), poly(3-hydroxybutyrate-3-hydroxyhexanoate), and poly(3-hydroxybutyrate-co-3-hydroxyvalerate-co-3-hydroxyhexanoate).

The PHA is preferably one or more polyester selected from the group consisting of poly(3-hydroxypropionate), poly(3-hydroxybutyrate), poly(4-hydroxybutyrate), poly(3-hydroxyvalerate), poly(3-hydroxybutyrate-co-4-hydroxybutyrate), poly(3-hydroxybutyrate-3-hydroxyhexanoate), and poly(3-hydroxybutyrate-co-3-hydroxyvalerate). The PHA is most preferably poly(3-hydroxybutyrate).

The polybutylene adipate terephthalate is preferably a block copolymer. The polylactic acid-polyethylene glycol is preferably a block copolymer.

The polysaccharide may be one or more selected from the group consisting of starch, cellulose, arabinoxylan, chitin, and pectin. The polysaccharide is preferably starch or cellulose.

A plasticizer may be added to the polysaccharide, in order to improve the thermoplastic properties of the polysaccharide. Thus, a thermoplastic polysaccharide comprising a polysaccharide and a plasticizer is obtained.

The plasticizer may be one or more compound(s) selected from the group consisting of polyhydric alcohols, diols, esters of polyhydric alcohols and aliphatic esters of mono-, di- or polycarboxylic acids. The plasticizer is preferably a polyhydric alcohol or a diol and most preferably one or more compound(s) selected from glycerol, glycol, and sorbitol. The glycerin may be vegetable glycerin (VG). Vegetable glycerin is glycerin obtained from plant oils such as soybean oil, coconut oil or palm oil.

The thermoplastic polysaccharide preferably comprises at least one of starch and cellulose. In other words, the thermoplastic polysaccharide is preferably thermoplastic starch, thermoplastic cellulose or a combination thereof, and more preferably thermoplastic starch. The thermoplastic starch preferably comprises one or more plasticizer selected from the group consisting of glycerol, glycol, and sorbitol.

The polymer used in the present invention may also be a polysaccharide ether, a polysaccharide ester or a polysaccharide ether ester.

The polysaccharide ether is preferably a cellulose ether. The polysaccharide ether is more preferably carboxymethyl cellulose, methyl cellulose, ethyl cellulose, hydroxyethyl cellulose, hydroxypropyl cellulose, ethyl methyl cellulose, and hydroxypropyl methyl cellulose. The polysaccharide ether is most preferably carboxymethyl cellulose, methyl cellulose, and hydroxyethyl cellulose.

The polysaccharide ester may be a cellulose ester such as cellulose acetate.

The polysaccharide ether ester may be a cellulose ether ester such as hydroxypropyl methyl cellulose acetate succinate and carboxymethyl cellulose acetate butyrate.

The polymer is most preferably one or more selected from the group consisting of poly(3-hydroxybutyrate), poly(4-hydroxybutyrate), polylactic acid, polylactic acid-polyethylene glycol block copolymer, polybutylene adipate terephthalate and thermoplastic starch.

The coating used in the present invention may comprise 10 to 90 wt.-% of the polymer, preferably 20 to 90 wt.-% of the polymer, more preferably 40 to 90 wt.-% of the polymer, even more preferably 60 to 90 wt.-% of the polymer, and most preferably 60 to 80 wt.-% of the polymer based on the total weight of the coating. When a coating comprising 10 to 90 wt.-% of the polymer is applied to the cellulose layer, it was surprisingly found that a good heat-sealability comparable to a coated paper coated with a petroleum-based polymer such as styrene-butadiene copolymer is obtained. The heat-sealability is particularly good when the coating on the cellulose layer comprises 60 to 90 wt.-% of the polymer.

The coated paper according to the present invention does preferably not contain a petroleum-based polymer.

Wax

The coating on at least one side of the cellulose layer comprises a wax.

A coating on the cellulose layer which comprises a wax results in improved hydrophobicity, improved slip properties and improved non-abrasive properties of the coated paper. Such coating also enhances surface and barrier characteristics in aqueous coating systems.

The wax may preferably be a plant wax or an animal wax and is more preferably a plant wax.

Animal waxes typically consist of wax esters derived from a variety of fatty acids and carboxylic alcohols. The animal wax may be a wax selected from the group of insects secrete waxes, spermaceti and lanolin.

The insect wax is preferably beeswax. A major component of beeswax is myricyl palmitate which is an ester of triacontanol and palmitic acid. The melting temperature of beeswax is in the range of 60 to 65° C. Spermaceti occurs in large amounts in the head oil of the sperm whale. Spermaceti comprises cetyl palmitate as a main constituent. Lanolin is a wax obtained from wool and comprises esters of sterols.

Plant waxes are complex mixtures of hydrocarbons, alcohols, aldehydes, ketones, esters, acids, and combinations of these that are deposited in a layer outside the epidermal cells. Plant waxes are generally water-repellent components found in an amorphous layer on the outer surface of plants. Plant waxes within the meaning of the present invention also comprise waxes obtained from plant oils or vegetable oils by chemical reactions such as hydrogenation.

The plant wax may be more preferably one or more selected from the group consisting of candelilla wax, carnauba wax, rice bran wax, soy wax, sugar cane wax and sunflower wax.

The coating may comprise a first coating layer and a second coating layer, wherein the first coating layer comprises the wax and a filler, and the second coating layer comprises the wax and the polymer. In this case, the first coating layer preferably comprises sugarcane wax as the plant wax and even more preferably comprises sugarcane wax as the plant wax and kaolinite as the filler.

Candelilla wax is mainly obtained from the leaves of plant *Euphorbia antisyphilitica* Zuccarini. Unpurified candelilla wax contains approximately 40-45 wt.-% hydrocarbons, 35-45 wt.-% wax, resin and sitosteroyl esters, 5-10 wt.-% free wax and resin acids, 4-8 wt.-% lactones, and 2-8 wt.-% free wax and resin alcohols.

Carnauba wax is mainly obtained from the Brazilian palm Coernicia cerifera Martius, also known as carnauba wax palm. It is found on the upper and lower surface of the palm leaves. Carnauba wax contains a high proportion of unesterified alcohols, x-hydroxy esters and esters of hydroxylated cinnamic acid. Carnauba wax is one the hardest plant waxes and has a melting temperature of about 80° C.

Rice bran wax is another high melting wax found in husks of rice *Oryza sativa*. It is obtained as a by-product from the de-waxing of rice bran oil. The major components of rice bran wax are even-numbered aliphatic acids and higher alcohol esters. Other constitutes include free fatty acids (palmitic acid), phospholipids, phytosterols and squalene. The hydrocarbon content of rice bran wax is typically as low as 2 wt.-%.

Sunflower wax is found in the seed and seed hulls of *Helianthus annuus* (sunflower). It is obtained through the winterization of sunflower oil. Sunflower wax is a hard, high melting wax mainly consisting of long chain saturated fatty esters.

Soy wax can be obtained by hydrogenation of soybean oil. It is a triglyceride, containing a high proportion of stearic acid. It is typically softer than paraffin wax and has a lower melting temperature compared to paraffin wax. Its melting point is in the range from about 50° C. to about 80° C.

Sugarcane wax is indigestible and harmless to health. In its refined form it has a light yellowish colour. Due to the high melting point of 75 to 80° C. it remains stable even if exposed to direct sunlight. Sugarcane wax offers a good oil and solvent retention for anionic bright emulsions.

The wax used in the present invention is preferably one or more wax selected from the group consisting of rice bran wax, soy wax, sugar cane wax, and beeswax.

The wax has preferably a dropping point in the range of 60° C. to 120° C., and more preferably in the range of 60 to 110° C. The dropping point is a characteristic property of a wax. For determining the dropping point, samples are heated until they transform from a solid into a liquid state. Specifically, the dropping point is the temperature at which the first drop of a molten substance precipitates from a standardized cup with a defined orifice under controlled testing conditions in a furnace. In the present invention, the dropping point may be determined according to the procedure described in DIN ISO 2176: 1997-05.

The coating used in the present invention may preferably comprise 10 to 90 wt.-% of the wax, more preferably 10 to 80 wt.-% of the wax, even more preferably 10 to 60 wt.-% of the wax, and most preferably 10 to 40 wt.-% of the wax based on the total weight of the coating. When such coating is applied to the cellulose layer, it was surprisingly found that the heat-sealability and the water vapor barrier properties of the coated paper are improved compared to a paper coated only with a polymer.

The coating used in the present invention may preferably comprise 10 to 90 wt.-% of the wax and 10 to 90 wt.-% of the polymer, and may more preferably comprise 10 to 40 wt.-% of the wax and 60 to 90 wt.-% of the polymer, based on the total weight of the coating. When such coating is applied to the cellulose layer, it was surprisingly found that a good heat-sealability of the coated paper is obtained and is significantly improved compared to a paper coated only with a wax. In addition, a paper coated with a coating comprising 10 to 90 wt.-% of the wax and 10 to 90 wt.-% of the polymer, based on the total weight of the coating, combines a paper-like look and feel with a workability and heat-sealability comparable to a plastic film. The heat-sealability of the coated paper is further improved when the coating comprises 10 to 40 wt.-% of the wax and 60 to 90 wt.-% of the polymer, based on the total weight of the coating. In addition, a coated paper with a coating comprises 10 to 40 wt.-% of the wax and 60 to 90 wt.-% of the polymer, based on the total weight of the coating, exhibits improved water-vapor barrier properties. In a particularly preferable embodiment, the coating comprises 20 to 40 wt.-% of the wax and 60 to 80 wt.-% of the polymer, based on the total weight of the coating. In such coating the best compromise between water vapor barrier properties and heat-sealability is achieved.

Additive

The coating used in the present invention may comprise one or more additive. The additive may be at least one compound selected from the group consisting of a rheology modifier and a softener.

Rheology Modifier

The coating used in the present invention may comprise a rheology modifier. The rheology modifier is preferably one or more compound selected from the group consisting of cellulose, starch or a derivative thereof.

The rheology modifier is preferably water-soluble or water-dispersible. The rheology modifier is more preferably biomass-based and/or biodegradable.

The rheology modifier allows to thicken the emulsion and to improve emulsion stability. Thus, dripping during application of the coating can be avoided.

The use of a rheology modifier selected from the group consisting of cellulose, starch and a derivative thereof improves the emulsion stability of the coating. At the same time, such rheology modifier is sustainable because it is water-soluble or water-dispersible, biomass-based and biodegradable. Thus, a sustainable and more environmentally friendly heat-sealable coated paper, which is suitable for the use as a packaging material and which has the desired, preferably paper-like, look and feel can be obtained.

The cellulose may be ultrafine cellulose, preferably powdered ultrafine cellulose such as ARBOCEL produced by JRS.

The cellulose derivative may be a cellulose ether or a cellulose ether ester. The cellulose ether is preferably carboxymethyl cellulose, methyl cellulose, ethyl cellulose, hydroxyethyl cellulose, hydroxypropyl cellulose, ethyl methyl cellulose, and hydroxypropyl methyl cellulose. The cellulose ether is more preferably carboxymethyl cellulose, methyl cellulose, and hydroxyethyl cellulose. The hydroxyethyl cellulose may for example be Cellosize™ QP-100 produced by Dow. The cellulose ether ester may be hydroxypropyl methyl cellulose acetate succinate and carboxymethyl cellulose acetate butyrate.

The starch derivative may for example be phosphated distarch phosphate, preferably phosphated distarch phosphate based on waxy corn such as AGENAJEL 20.350 produced by AGRANA STÄRKE.

The coating preferably comprises 0 to 3 wt.-%, and more preferably 0.5 to 2 wt.-% of rheology modifier, based on the total weight of the coating.

Softener

The coating used in the present invention may comprise a softener.

The softener may be one or more compound(s) selected from the group consisting of polyhydric alcohols, diols, esters of polyhydric alcohols and aliphatic esters of mono-, di- or polycarboxylic acids. The softener is preferably a polyhydric alcohol or a diol and most preferably one or more compound(s) selected from glycerol, glycol, and sorbitol. The glycerin may be vegetable glycerin (VG). Vegetable glycerin is glycerin obtained from plant oils such as soybean oil, coconut oil or palm oil.

The addition of a softener further improves the workability of the coating and the heat-sealability of the coated paper.

Glycerol, glycol, and sorbitol are water-soluble, biodegradable and can be produced from biomass. Therefore, a coating comprising a softener selected from the group consisting of glycerol, glycol, and sorbitol is sustainable and environmentally friendly.

The coating preferably comprises 0 to 10 wt.-%, and more preferably 2 to 7 wt.-% of the softener, based on the total weight of the coating.

Filler

The coating used in the present invention may comprise a filler.

The coating may comprise a first coating layer and a second coating layer, wherein the first coating layer comprises the wax and a filler, and the second coating layer comprises the wax and the polymer. In this case, the first coating layer preferably comprises 50 to 98 wt.-%, more preferably 60 to 95 wt.-%, and most preferably 70 to 95 wt.-% of the filler relative to the basis weight of the first coating layer.

The filler may be an inorganic filler. The filler is preferably a filler based on naturally occurring raw materials such as clay, for reasons of sustainability and environmental protection. The filler is even more preferably a clay mineral and most preferably a layered silicate mineral such as kaolinite. The filler may also be a pigment and more preferably a pigment based on naturally occurring raw materials such as clay, preferably a layered silicate mineral such as kaolinite.

The pigment may have a steep particle size distribution. In a most preferred embodiment, 90 wt.-% of the pigment particles have a particle size of less than 5 μm. Such a particle size distribution results in improved print and sheet gloss. The pigment is preferably applied in the form of a slurry. For example, a high brightness coating pigment such as CAPIM DG slurry from Capim Kaolin may be used. The good rheological properties of a slurry of pigment particles with the above-described particle size distribution allows for high speed application of the filler, for example in high speed blade and metered size press applications.

The coating preferably comprises 0 to 20 wt.-%, and more preferably 3 to 15 wt.-% of the filler, based on the total weight of the coating.

In a preferred embodiment, the coating comprises 10 to 90 wt.-% of the polymer, 10 to 90 wt.-% of the wax, 0 to 3 wt.-% of rheology modifier, 0 to 10 wt.-% of softener and 0 to 20% of a filler, based on the total weight of the coating. In a more preferred embodiment, the coating comprises 60 to 90 wt.-% of the polymer, 10 to 40 wt.-% of the wax, 0 to 3 wt.-% of rheology modifier, 0 to 10 wt.-% of softener and 0 to 20% of a filler. In an even more preferred embodiment, the coating consists of 60 to 90 wt.-% of the polymer, 10 to 40 wt.-% of the wax, 0 to 3 wt.-% of rheology modifier, 0 to 10 wt.-% of softener and 0 to 20% of a filler. In a most preferred embodiment, the coating consists of 60 to 80 wt.-% of the polymer, 20 to 40 wt.-% of the wax, 0 to 3 wt.-% of rheology modifier, 0 to 10 wt.-% of softener and 0 to 20% of a filler.

Basis Weight

In the present invention, the coating can be present on one side only of the cellulose layer or on both side of the cellulose layer. The term "one side of the cellulose layer" within the meaning of the present invention is synonymous to "one surface of the cellulose layer" and the term "both sides of the cellulose layer" within the meaning of the present invention is synonymous to "both surfaces of the cellulose layer".

The coating on at least one side of the cellulose layer may have a basis weight of 1 to 25 g/m$^2$, preferably from 3 to 20 g/m$^2$ and most preferably 4 to 15 g/m$^2$. When the coating is applied on both sides of the cellulose layer the basis weight may be 1 to 25 g/m$^2$, preferably 3 to 20 g/m$^2$, and most preferably 4 to 15 g/m$^2$ per each side. More specifically, when the cellulose layer comprises the coating on both sides, i.e. on both surfaces of the cellulose layer, the total basis weight of the coating may be 2 to 50 g/m$^2$, preferably 4 to 40 g/m$^2$, and most preferably 5 to 20 g/m$^2$.

The coating may comprise a first coating layer and a second coating layer, wherein the first coating layer comprises the wax and a filler, and the second coating layer comprises the wax and the polymer. In this case, the total basis weight of the first coating layer and the second coating layer is preferably 4 to 17 g/m$^2$ and more preferably 8 to 12 g/m$^2$. The basis weight of the first coating layer is preferably 1 to 7 g/m$^2$ and the basis weight of the second coating layer is preferably 3 to 10 g/m$^2$.

Cellulose Layer

The cellulose layer of the coated paper according to the present invention has preferably a basis weight of 20 to 100 g/m$^2$ and, more preferably, 30 to 70 g/m$^2$.

The coated paper according to the present invention has preferably a basis weight of 21 to 125 g/m$^2$, more preferably, 33 to 90 g/m$^2$, and most preferably 40 to 80 g/m$^2$. A coated paper having a basis weight in this range shows excellent flexibility and stiffness and is therefore suitable for the use as a packaging material. A coated paper having a basis weight of less than 21 g/m$^2$ may tear easily. A paper having basis weight of more than 125 g/m$^2$ is less flexible, which is disadvantageous for the use as a packaging material.

The cellulose layer has preferably a thickness of 35 to 200 μm, more preferably 40 to 160 μm. If the cellulose layer is not subjected to a step of compressing in machine direction to obtain an extensible cellulose layer, the cellulose layer has even more preferably a thickness of 40 to 70 μm, and most preferably 50 to 60 μm. If the cellulose layer is subjected to a step of compressing in machine direction, such as creping, the cellulose layer after compressing in machine direction has even more preferably a thickness of 60 to 150 μm, and most preferably of 60 to 100 μm.

The basis weight of the cellulose layer and the basis weight of the coated paper are determined according to ISO 536:2012. The thickness of the cellulose layer and of the coated paper can be determined according to EN ISO 534:2011 with a compressive load of 1.0 bar.

Extensibility

The cellulose layer may be extensible. When the cellulose layer is extensible, the coated paper can undergo large deformations in converting or end use applications.

When the cellulose layer is extensible, the coated paper of the present invention exhibits improved elongation and elasticity, especially in machine direction. Thus, a coated paper having an extensible cellulose layer ("extensible coated paper") exhibits mechanical properties comparable to plastic films, which are conventionally used as packaging material. Therefore, an extensible coated paper is even more suitable to be utilized on the same machine used for plastic packaging because of its increased elongation and elasticity.

In addition, it was surprisingly found that compressing the cellulose layer in machine direction, for example by creping, improves the coating adhesion and the heat-sealability of the coated paper. It is assumed that the improved coating adhesion and heat-sealability is due to the uneven surface structure of the extensible cellulose layer.

As a result, the extensible coated paper is an even more suitable packaging material and exhibits an improved workability and heat-sealability compared to a coated paper with a cellulose layer which is not extensible.

High extensibility of the cellulose layer can be created by compressing the cellulose layer in machine direction (MD) and preferably by compacting the moist or dry paper web in machine direction (MD).

The compressing in machine direction can be achieved by subjecting the cellulose layer to a step of creping or by using a Clupak unit. These processes are described in detail in the section directed to the method of manufacturing a coated paper according to the third aspect of the present invention.

An extensible coated paper within the meaning of the present invention is a coated paper having a tensile strength in machine direction and an elongation at break in machine direction as defined in the following. More particularly, an extensible coated paper within the meaning of the present invention has a tensile strength in machine direction of preferably 40-120 N/15 mm, and more preferably 60-100 N/15 mm, and an elongation at break in machine direction of preferably 3.5-25.0%, more preferably 4.5-15.0%, even more preferably 5.5-12.0%, and most preferably 6.0 to 8.0%. In a particularly preferred embodiment, the extensible coated paper has a tensile strength in machine direction of 60-100 N/15 mm and an elongation at break in machine direction of 6.0-8.0%.

The tensile strength of the coated paper in machine direction is preferably 40-120 N/15 mm, more preferably 60-100 N/15 mm. The tensile strength of the heat sealable paper in cross direction is 15-70 N/15 mm, more preferably 20-60 N/15 mm, and most preferably 30-50 N/15 mm.

The bending stiffness of the coated paper in machine direction is preferably 0.05-0.4 Nmm and more preferably 0.10-0.25 Nmm. The bending stiffness in cross direction is preferably 0.01-0.1 Nmm and, more preferably, 0.01-0.06 Nmm.

The Cobb value of the coated paper as measured on a side comprising the coating is preferably 1-20 g/m$^2$, more preferably 1-12 g/m$^2$, and even more preferably 1-8 g/m$^2$.

The coated paper preferably has a tear resistance in machine direction of 100-1000 mN, more preferably 300-800 mN and even more preferably 500-800 mN. The tear resistance in cross direction is preferably 100-1000 mN, more preferably 300-800 mN and even more preferably 500-800 mN.

The coated paper preferably has an elongation at break in machine direction 3.5-25.0%, more preferably 4.5-8.0% and even more preferably 6.0-7.0%.

Packaging Material

In a second aspect, the present invention relates to a packaging comprising the coated paper according the first aspect of the present invention.

Method of Manufacturing a Coated Paper

In a third aspect, the present invention is directed to a method of manufacturing a coated paper.

The method according to the third aspect of the present invention comprises the steps of providing a cellulose layer, applying an aqueous dispersion or emulsion of a first coating composition comprising a wax and an aqueous dispersion or emulsion of a second coating composition comprising a polymer selected from the group consisting of polyester, polysaccharide, polysaccharide ester, polysaccharide ether and polysaccharide ether ester to at least one surface of the cellulose layer to form a coating comprising the wax and the polymer, and drying the coating to form a coated paper.

In one embodiment, the coating may comprise a first coating layer and a second coating layer, wherein the first coating layer comprises a wax and a filler, and the second coating layer comprises a wax and a polymer. In this case, the coated paper is prepared by the following method comprising the steps of providing a cellulose layer, applying an aqueous dispersion or emulsion of a first coating composition comprising a wax and a filler to at least one surface of the cellulose layer to form a first coating, drying the first coating to form a first coating layer, applying an aqueous dispersion or emulsion of a second coating composition comprising a wax and a polymer selected from the group consisting of polyester, polysaccharide, polysaccharide ester, polysaccharide ether and polysaccharide ether ester on the first coating layer to form a second coating comprising the wax and the polymer, and drying the second coating to form a second coating layer.

The method according to the third aspect of the present invention may be used to prepare the coated paper according to the first aspect of the present invention.

Saturation

The cellulose layer can optionally be saturated before application of the coating. Any resin commonly used to saturate paper such as styrene butadiene latex can be used in the present invention, but the saturation is more preferably performed with an aqueous dispersion based on a latex of a biomass-based and/or biodegradable polymer.

In the present specification, the term "saturation" is understood as synonymous with "impregnation". The amount of saturation resin in the heat-sealable paper is 2-15 g/m$^2$, preferably 3 to 12 g/m$^2$, and even more preferably 4-10 g/m$^2$. It is preferable to saturate the cellulose layer when the coating is applied on only one side of the cellulose layer. By using a saturated cellulose layer, the cohesion between the uncoated side and the coated side of the cellulose layer can be improved. This is advantageous for the use as heat-sealable wrapping paper.

The coated paper is preferably saturated with a composition corresponding to the coating composition of the coated paper, i.e. a composition comprising a wax and a polymer selected from the group consisting of polyester, polysaccharide, polysaccharide ester, polysaccharide ether and polysaccharide ether ester and most preferably with an aqueous emulsion comprising a wax and a polyester.

The composition used for saturation may also comprise one or more compound selected from the group consisting of polyethylene glycol, polyvinyl alcohol, softener and inorganic filler.

The inorganic filler is preferably based on naturally occurring raw materials for reasons of sustainability and environmental protection. The inorganic filler is even more preferably a clay mineral or a carbonate mineral, and most preferably bentonite, calcium carbonate, talc, or kaolinite. In a particularly preferred embodiment, the inorganic filler comprised in the saturation composition may be a filler as defined above for use in the coating of the coated paper. The inorganic filler may also be a pigment and more preferably a pigment based on naturally occurring raw materials such as clay, preferably a layered silicate mineral such as kaolinite.

The softener comprised in the saturation composition may be one or more compound(s) selected from the group consisting of polyhydric alcohols, diols, esters of polyhydric alcohols and aliphatic esters of mono-, di- or polycarboxylic acids. The softener is preferably a softener as defined above for use in the coating of the coated paper. The softener is more preferably a compound selected from the group consisting of glycerol, glycol, and sorbitol.

Thus, the filler and/or the softener can be applied to the cellulose layer either by coating the cellulose layer with coating compositions comprising the filler and/or the softener or, by saturating the cellulose layer prior to coating with a saturation composition comprising the (inorganic) filler and the softener.

In both cases, the same filler and the same softener may be used.

Coating

In the step of forming the coating on the cellulose layer, the first and second coating compositions may be applied to only one side of the cellulose layer. The first and second coating compositions may also be applied to both sides of the cellulose layer, i.e. each of the first and second coating composition may be applied to each of the two opposing sides of the cellulose layer. In a preferred embodiment of the present invention, the coating compositions are applied to only one side of the cellulose layer.

The coating may be formed by applying the first and the second coating composition to the surface of the cellulose layer and subsequently curing and/or drying the surface coating composition. The surface coating compositions may be applied to the surface of the cellulose layer by spraying, brushing, or rolling. Upon application to the surface, the surface coating composition undergoes film formation. Preferably, liquid surface coating compositions of relatively low viscosity are applied to the cellulose layer and are cured to form a solid, high-molecular-weight, polymer-based adherent film. The coating may also be formed by coalescence-based film formation. Coalescence-based film formation takes place with polymer particles dispersed in a liquid phase, preferably with latex polymers, and most preferably with water-dispersed polymers selected from the group consisting of polyester, polysaccharide, polysaccharide ester, polysaccharide ether and polysaccharide ether ester.

The first coating composition is an aqueous dispersion or emulsion comprising a wax.

The wax is preferably a wax as defined in the first aspect of the present invention. In other words, the wax is preferably a plant wax or an animal wax and is more preferably a plant wax. The wax comprised in the first coating compositions is most preferably one or more selected from the group consisting of candelilla wax, carnauba wax, rice bran wax, soy wax, sugar cane wax, sunflower wax and beeswax. The wax has preferably a dropping point in the range of 60° C. to 120° C.

The first coating composition is preferably an aqueous emulsion comprising a wax and more preferably an aqueous emulsion comprising a wax and an emulsifier.

Emulsifiers are compounds that typically have a polar moiety and a non-polar moiety. Surfactants may be used as the emulsifier. The emulsifier is preferably an anionic or a non-ionic emulsifier and more preferably an anionic emulsifier. Examples of water-based emulsions of a wax are EurikaCoat SW 166 from Eurikas and HydroWax RV from Sasol. EurikaCoat SW 166 is a water-based emulsion comprising a soy wax, a vegetable-based wax and an anionic emulsifier. HydroWax RV is an anionic emulsion of finely dispersed wax particles in water, wherein the wax is a mixture of synthetic waxes and plant waxes.

The solid content of the first coating composition, which is an aqueous dispersion or emulsion comprising a wax, is preferably 10 to 45 wt.-%. The viscosity of the first coating composition is preferably 200 to 1600 mPas, more preferably 500 to 1200 mPas.

The second coating compositions is an aqueous dispersion or emulsion comprising a polymer selected from the group consisting of polyester, polysaccharide, polysaccharide ester, polysaccharide ether and polysaccharide ether ester. The second coating compositions is preferably an aqueous emulsion.

The polymer is preferably a polymer as defined in the first aspect of the present invention. The polymer is more preferably a thermoplastic polymer with a melting point in the range of 60 to 200° C. The polymer is most preferably one or more selected from the group consisting of poly(3-hydroxybutyrate), poly(4-hydroxybutyrate), polylactic acid, polylactic acid-polyethylene glycol block copolymer, polybutylene adipate terephthalate and thermoplastic starch.

The solid content of the second coating composition, which is an aqueous dispersion or emulsion comprising a polymer, is preferably 15 to 55 wt.-%. The viscosity of the second coating composition is preferably 200 to 2200 mPas, more preferably 800 to 1800 mPas.

One or both of the first and the second coating composition may comprise an additive selected from the group of a rheology modifier and a softener. One or both of the first and the second coating composition may comprise a filler.

The rheology modifier, the softener and the filler are as defined in the first aspect of the present invention.

Drying

After application of the first and second coating compositions, the coating is dried to form a coated paper. Drying may be carried out by blowing hot dry air onto the coating, thus raising the coating temperature to a point where water is evaporated from the coated paper, leaving a relatively dry coated paper. In the drying process, the web temperature, i.e. the temperature of the cellulose layer, must be lower than the dropping point of the wax. Thus, the web temperature during drying is preferably less than 120° C. The web temperature of the paper can be determined by means of non-contact temperature measurement using an infrared, non-contact thermometer.

Compressing the Cellulose Layer

Preferred embodiments of the method of manufacturing a coated paper according to the third aspect of the present invention are subject to the dependent claims. When the coated paper of the present invention is subjected to a step of compressing in machine direction, it is even more suitable to be utilized on the same machine used for plastic packaging because of its increased extensibility, elongation, elasticity and coating adhesion.

Creping

The compressing in machine direction can be achieved by subjecting the cellulose layer to a step of creping. Creping can be performed inside the paper machine (wet creping) or outside the paper machine (dry creping).

More particularly, during creping, the cellulose layer is moving on a crepe cylinder and is removed with a doctor blade, passed over the surface of the doctor blade to a transfer device, wherein the creping is controlled by retarding the speed of the transfer device, preferably by 10 to 50%, relative to the crepe cylinder. The degree of creping, i.e. the number of folds, can be controlled by adjusting the speed difference between the crepe cylinder and the transfer device. In addition, the microstructure can be controlled by the geometry and the angle of the doctor blade.

In this process, the dry content of the cellulose layer is preferably in the range of 30 to 50 wt.-%, preferably 35 to 45%.

Clupak Unit

Compressing of the cellulose layer in machine direction can also be achieved by using a Clupak unit.

A Clupak extensible unit comprises a cylinder, a nip bar, a gap between the cylinder and the nip bar, and a rubber band (rubber blanket) located in the gap. In a Clupak extensible unit, the rubber blanket has to pass through the gap between the drying cylinder and a nip bar.

The nip can be considered as a Venturi section formed by a rotating drying cylinder and the static nip bar, in which the endless rubber blanket is accelerated. The paper web follows the dimensional changes of the rubber surface in the nip due to friction forces between paper and rubber. This is a consequence of a high radial nip pressure and a simultaneous slippage of the paper on the cylinder surface. The dimensional changes of the rubber surface are induced by bending and by the Venturi effect. First, the surface of the rubber blanket closer to the paper web is stretched through bending over the nip bar and it is further stretched because of the Venturi effect. The stretched rubber surface then comes into contact with the moist paper web. After passing the center of the nip, the stretched rubber surface starts to recoil due to the deceleration caused by Venturi effect and bending of the rubber in the opposite direction. The paper web compacts in MD while following the shrinkage of the rubber surface in the second half of the nip and these events in the nip become more pronounced with increasing nip width. The final compression level is adjusted by controlling the speed difference of the paper web between inlet and outlet of the Clupak nip.

Compressing in machine direction by the use of a Clupak unit creates a microcreping effect in the paper network through curling of the fibers. The cellulose layer is compressed and the fibers are therefore pushed closer together, so that the cellulose layer is compressed in the machine direction. In this way, a series of small, generally discontinuous parallel folds are imparted to the cellulose layer. Microcreping differs from creping primarily in a larger number of the imparted folds and, thus, a larger number of overlaying folds. It was surprisingly found that microcreping does not only increase the elongation of the paper substrate but also further increases the adhesion of the subsequently applied coating compared to creping by the use of a creping cylinder. In addition, microcreping improves the heat-sealability of the coated paper.

Calendering

The cellulose layer used for the production of the coated paper of the present invention may be subjected to a step of calendaring prior to coating.

The coated paper of the present invention may also be subjected to a step of calendaring after the steps of coating and drying.

Calendering improves the smoothness and glossiness of the coated paper.

EXAMPLES

Example 1

A heat-sealable paper has been produced on a paper machine. Only cellulose fibers have been used for the cellulose layer (i.e. 100% cellulose fibers) in combination with other additives commonly used for paper production. Alkyl ketene dimers have been used as sizing agent. The cellulose layer has been compressed in machine direction using a Clupak extensible unit. In this example, the compressed cellulose layer has been coated on one side with a first aqueous emulsion of sugarcane wax and a second aqueous emulsion of polylactic acid. After drying, the coating consists of 40 wt.-% of sugarcane wax and 60 wt.-% of polylactic acid based on the total weight of the coating. The total amount of the coating in the final product is 6 g/m$^2$. Thus, the heat-sealable coated paper contains 3.6 wt.-% of sugarcane wax and 5.5 wt.-% of polylactic acid based on the total weight of the coated paper.

The features of the so obtained heat sealable paper are listed in Table 1. In Table 1, the acronym MD means machine direction and CD means cross direction.

TABLE 1

| | Heat sealable paper |
|---|---|
| Thickness (μm) | 90 |
| Basis weight of cellulose layer (g/m$^2$) | 60.2 |
| Basis weight after coating (g/m$^2$) | 66.4 |
| Tensile strength MD (N/15 mm) | 75 |
| Tensile strength CD (N/15 mm) | 50 |
| Cobb Value[A] (g/m$^2$) | 5 |
| Tear resistance MD (mN) | 600 |
| Tear resistance CD (mN) | 630 |
| Elongation at break MD (%) | 6 |
| Elongation at break CD (%) | 8 |
| Seal strength [N/25 mm] at a sealing temperature of 140° C. | 3.2 |
| Seal strength [N/25 mm] at a sealing temperature of 150° C. | 3.3 |
| Seal strength [N/25 mm] at a sealing temperature of 160° C. | 3.4 |
| Moisture vapor transmission rate (MVTR) [g/(m$^2$ d)] | 120 |

[A]Measured on the coated side

Example 2

A heat-sealable paper has been produced on a paper machine. Only cellulose fibers have been used for the cellulose layer (i.e. 100% cellulose fibers) in combination with other additives commonly used for paper production. Alkyl ketene dimers have been used as sizing agent. The cellulose layer has been compressed in machine direction using a Clupak extensible unit. In this example, the compressed cellulose layer has been coated on one side with a first aqueous emulsion of soy wax and a second aqueous emulsion of polyhydroxybutyric acid (poly-3-hydroxybutyrate). After drying, the coating consists of 20 wt.-% of soy wax and 80 wt.-% of polyhydroxybutyric acid (poly-3-hydroxybutyrate) based on the total weight of the coating. The total amount of the coating in the final product is 10 g/m$^2$. Thus, the heat-sealable coated paper contains 2.9 wt.-% of soy wax and 11.4 wt.-% of polyhydroxybutyric acid (poly-3-hydroxybutyrate) based on the total weight of the coated paper.

The features of the so obtained heat sealable paper are listed in Table 2. In Table 2, the acronym MD means machine direction and CD means cross direction.

TABLE 2

| | Heat sealable paper |
|---|---|
| Thickness (μm) | 90 |
| Basis weight of cellulose layer (g/m$^2$) | 60.3 |
| Basis weight after coating (g/m$^2$) | 70.4 |
| Tensile strength MD (N/15 mm) | 75 |
| Tensile strength CD (N/15 mm) | 50 |
| Cobb Value[A] (g/m$^2$) | 4 |
| Tear resistance MD (mN) | 600 |
| Tear resistance CD (mN) | 630 |
| Elongation at break MD (%) | 6 |
| Elongation at break CD (%) | 8 |
| Seal strength [N/25 mm] at a sealing temperature of 140° C. | 4.4 |
| Seal strength [N/25 mm] at a sealing temperature of 160° C. | 4.6 |
| Moisture vapor transmission rate (MVTR) [g/(m$^2$ d)] | 60 |

[A]Measured on the coated side

Example 3

A heat-sealable paper has been produced on a paper machine. Only cellulose fibers have been used for the cellulose layer (i.e. 100% cellulose fibers) in combination with other additives commonly used for paper production. Alkyl ketene dimers have been used as sizing agent. The cellulose layer has been compressed in machine direction using a Clupak extensible unit. In this example, the compressed cellulose layer has been coated on one side with a first coating formulation comprising an aqueous emulsion of sugarcane wax and an aqueous dispersion of kaolinite with a narrow particle size distribution. After drying, the coating consists of 7 wt.-% of sugarcane wax and 93 wt.-% of kaolinite based on the total weight of the coating.

The cellulose layer coated with the first coating layer is subsequently coated with a second coating formulation on the side coated with the first coating layer. The second coating formulation comprises an aqueous emulsion of sugarcane wax and a second aqueous emulsion of polylactic acid. After drying, the coating consists of 40 wt.-% of sugarcane wax and 60 wt.-% of polylactic acid based on the total weight of the second coating. The total amount of the coatings in the final product is 10 g/m$^2$.

The features of the so obtained heat sealable paper are listed in Table 3. In Table 3, the acronym MD means machine direction and CD means cross direction.

TABLE 3

| | 2 coatings |
|---|---|
| Thickness (μm) | 90 |
| Basis weight of cellulose layer (g/m$^2$) | 60.3 |
| Basis weight after the first coating (g/m$^2$) | 65.8 |
| Basis weight after the second coating (g/m$^2$) | 69.8 |
| Tensile strength MD (N/15 mm) | 75 |
| Tensile strength CD (N/15 mm) | 50 |
| Cobb Value[4] (g/m$^2$) | 40 |
| Elongation at break MD (%) | 6 |
| Elongation at break CD (%) | 8 |
| Seal strength [N/25 mm] at a sealing temperature of 140° C. | 2.98 |
| Seal strength [N/25 mm] at a sealing temperature of 150° C. | 3.15 |
| Seal strength [N/25 mm] at a sealing temperature of 160° C. | 3.32 |
| Smoothness (S) (coating side) | 56.5 |
| Tear resistance MD (mN) | 660 |
| Tensile strength CD (N/15 mm) | 800 |
| moisture vapor transmission rate (MVTR) [g/(m$^2$ d)] | 60 |

[4]Measured on the coated side

A comparison of Examples 1 and 3 shows that, by the use of a first coating layer, the tear resistance in MD and CD as well as the water vapor barrier properties (as expressed by the moisture vapor transmission rate) of the coated paper can be improved. In addition, the use of a first coating layer allows to reduce the coating weight of the second coating layer, while the desired tensile strength, elongation at break, and seal strength of the coated paper can be maintained.

Tests Methods

In the following, the acronym MD means machine direction and CD means cross direction.

Standard atmospheres for conditioning and testing: according to DIN EN 20187:1993. The sample were first conditioned and then tested to determine the features indicated below.

Basis weight: according to ISO 536:2012.

Thickness: according to EN ISO 534:2011 with a compressive load of 1.0 bar.

Tensile strength (MD, CD) and elongation at break (MD, CD): according to DIN EN ISO 1924-2:2008 but sample width of 15 mm; test length 100 mm; and rate of elongation of 150 mm/min.

Cobb Value: according to ISO 535:2014. The sample was measured after 10 minutes.

Tear resistance (MD, CD): according to ISO 1974:2012 by using L & Tearing Tester from Lorentzen & Wettre (code 009, type 961701, number 5625) with pendulum: code A-pend, type 962035, number 1269. Two single layers have been used for the test.

Moisture Vapor Transmission Rate (MVTR):

Measured according to ISO 15106-3:2003-01. The measurement has been performed at a relative humidity of 50% at 23° C.

Seal strength: two samples are cut, each with a size of approx. 5 cm×20 cm, the longer side being the machine direction. The samples are placed with the sides to be sealed folded inwards, and heat sealed using a laminator, such as for example YOSAN LM-260. The setting temperature of the laminator is set to a temperature in the range of 140 to 160° C. The sample is moved once into the laminator and once back with a velocity of 650 mm/min and for a length of 15 cm, thereby having 5 cm in the entire length that is not sealed. After this step the sample is left to cool for 15 minutes at room temperature. The so obtained sealed sample is cut to a strip width of 25 mm by trimming both sides while the length is still 20 cm. The total length of the sample included 5 cm that are not sealed. The samples are then clamped in a universal testing machine such as Zwick/Roell Z0.5. In this step, the sample is clamped through the two parts of the sample which are not sealed and these two ends are pulled apart using a peeling test under the following conditions:

Program: Starting distance: 50 mm
Preload: 0.1N
Speed preload: 20 mm/min.
Measuring speed: 300 mm/min.
Starting length before measuring
Measuring path: 80 mm The maximum force detected in the measuring path represents the seal strength (i.e. F max).

The invention claimed is:

1. A coated paper comprising a cellulose layer and a coating on at least one side of the cellulose layer;

wherein the coating comprises a wax and a polymer, and one or more of: a filler, a rheology modifier, or a softener;

wherein the polymer is selected from the group consisting of polyester, polysaccharide, polysaccharide ester, polysaccharide ether and polysaccharide ether ester;

wherein the coated paper has a moisture vapor transmission rate of less than 200 (g/(m$^2$d)); and wherein the wax and polymer act together to form a heat-seal layer achieving heat sealability at 100° C. to 250° C.

2. The coated paper according to claim 1, wherein the coating comprises a first coating layer and a second coating layer, the first coating layer comprises the wax and a filler, and the second coating layer comprises the wax and the polymer.

3. The coated paper according to claim 1, wherein the filler is an inorganic filler.

4. The coated paper according to claim 3, wherein the inorganic filler is kaolinite.

5. The coated paper according to claim 2, wherein the first coating layer comprises 50 to 98 wt.-%, of the filler relative to the basis weight of the first coating layer.

6. The coated paper according to claim 2, wherein the first coating layer comprises sugarcane wax and kaolinite.

7. The coated paper according to claim 2, wherein the basis weight of the first coating layer is 1 to 7 g/m$^2$ and the basis weight of the second coating layer is 3 to 10 g/m$^2$.

8. The coated paper according to claim 1, wherein the wax is a plant wax.

9. The coated paper according to claim 8, wherein the plant wax is one or more selected from the group consisting of candelilla wax, carnauba wax, rice bran wax, soy wax, sugarcane wax and sunflower wax.

10. The coated paper according to claim 1, wherein the polymer is a polyester selected from the group consisting of polyhydroxyalkanoate, polylactic acid, polyglycolic acid, polybutylene succinate, polycaprolactone, polybutylene adipate terephthalate, and polylactic acid-polyethylene glycol.

11. The coated paper according to claim 1, wherein the polymer is thermoplastic starch.

12. The coated paper according to claim 1, wherein the polymer is selected from the group consisting of polyhydroxybutyrate, polylactic acid, polylactic acid-polyethylene glycol block copolymer, and thermoplastic starch.

13. The coated paper according to claim 1, wherein the coating further comprises at least one additive.

14. The coated paper according to claim 13, wherein the additive is at least one of a rheology modifier and a softener.

15. The coated paper according to claim 14, wherein the softener is glycerine.

16. The coated paper according to claim 14, wherein the rheology modifier is cellulose, starch or a derivative thereof.

17. The coated paper according to claim 1, wherein the coating comprises 10 to 90 wt.-% of the wax and 10 to 90 wt.-% of the polymer.

18. The coated paper according to claim 1, wherein the wax has a dropping point in the range of 60° C. to 120° C.

19. The coated paper according to claim 1, wherein the polymer has a melting point in the range of 60° C. to 180° C.

20. The coated paper according to claim 1, wherein the polymer is a thermoplastic polymer.

21. The coated paper according to claim 1, wherein the polymer is a biomass-based polymer.

22. The coated paper according to claim 1, which is biodegradable.

23. The coated paper according to claim 1, which does not contain a petroleum-based synthetic polymer.

24. The coated paper according to claim 1, wherein the basis weight of the coating on one side of the cellulose layer is 1 to 25 $g/m^2$.

25. The coated paper according to claim 1, wherein the cellulose layer has a basis weight of 20 to 100 $g/m^2$.

26. The coated paper according to claim 1, further having basis weight of 21 to 125 $g/m^2$.

27. The coated paper according to claim 1, which is extensible.

28. The coated paper according to claim 1, which is creped.

29. The coated paper according to claim 1, wherein the cellulose layer is saturated with the coating composition or a resin.

30. A packaging comprising the coated paper according to claim 1.

* * * * *